US005640654A

United States Patent [19]

Yoshizawa

[11] Patent Number: 5,640,654

[45] Date of Patent: Jun. 17, 1997

[54] COLOR IMAGE FORMING APPARATUS HAVING ROTARY DEVELOPING DEVICE

[75] Inventor: Katsumi Yoshizawa, Ebina, Japan

[73] Assignee: Fuji Xerox Co., Ltd., Tokyo, Japan

[21] Appl. No.: 543,436

[22] Filed: Oct. 16, 1995

[30] Foreign Application Priority Data

Oct. 19, 1994 [JP] Japan ..... 6-253972

[51] Int. Cl.[6] ..... G03G 15/01

[52] U.S. Cl. ..... 399/227

[58] Field of Search ..... 355/326 R, 327, 355/271, 272, 274, 275; 399/226, 227

[56] References Cited

U.S. PATENT DOCUMENTS

| | | | |
|---|---|---|---|
| 4,078,412 | 3/1978 | Suda et al. . | |
| 4,743,938 | 5/1988 | Ohno . | |
| 4,772,916 | 9/1988 | Mochida . | |
| 5,335,056 | 8/1994 | Muramatsu | 355/327 |
| 5,486,902 | 1/1996 | Ito | 355/208 |
| 5,508,796 | 4/1996 | Sasame et al. | 355/271 |

FOREIGN PATENT DOCUMENTS 4-337751 11/1992 Japan .

*Primary Examiner*—Robert Beatty
*Attorney, Agent, or Firm*—Oliff & Berridge

[57] ABSTRACT

A color image forming apparatus includes an image carrier member on which latent electrostatic images for respective colors are successively formed in accordance with image data, an image transfer member for transferring the toner images of the respective colors on a print sheet in a superimposed fashion, the image transfer member being turned in synchronism with the image carrier member while holding a print sheet thereon, the toner images being formed on the image transfer member every turn of the image transfer member, a plural number of developing subunits containing different colors respectively assigned thereto, and a developing unit. The developing unit sets one of the plural number of developing subunits to be used for developing a latent electrostatic image at a position facing the image carrier member. When one or more number of turns of the image transfer member are needed after the image transfer member is rotated one turn for transferring a toner image of a first color onto the print sheet but before the image transfer member is rotated one turn for transferring a toner image of a second color thereonto, the developing unit moves all of the developing subunits apart from the position facing the image carrier member during the period of time of one or more turns.

9 Claims, 14 Drawing Sheets

COLOR IMAGE FORMING APPARATUS HAVING ROTARY DEVELOPING DEVICE

BACKGROUND OF THE INVENTION

1. Field of the Invention

The present invention relates to a color image forming apparatus of the called multi-transfer type in which the toner images of color components are successively transferred onto a print sheet put on an image transfer member in a superposed fashion. More particularly, the invention relates to a color image forming apparatus of the type in which a plural number of developing units, which contain toner of different colors respectively assigned thereto, are successively set at a position facing an image carrier member one by one.

2. Discussion of the Conventional Art

A known color image forming apparatus of the called multi-transfer type includes a photoreceptor drum on which toner images are formed in accordance with image data, and an image transfer drum with a print sheet wound thereon. The photoreceptor drum is turned in synchronism with the image transfer drum. The toner images of different colors are successively formed on the photoreceptor drum being turned. These toner images are transferred onto the print sheet put on the image transfer drum in superposed fashion. The thus superposed toner image is fixed on the print sheet by a fixing unit.

In the color image forming apparatus, a plural number of developing units, which contain toner of different color components (e.g., black K, yellow Y, magenta M and cyan C) respectively assigned thereto, are disposed around the photoreceptor drum. In operation, one of the developing units is moved to a developing position facing the photoreceptor drum, and develops a latent electrostatic image on the photoreceptor drum. At this time, the remaining developing units are placed apart from the photoreceptor drum. To form a color image, those developing units are successively moved to the developing position one by one every time the developing process for the toner image of one color is completed. Accordingly, any of the developing units is always positioned at the developing position when the color image forming apparatus is placed in a developing mode.

When the color image forming apparatus is not in the image formation mode, namely, it is in a stand-by mode in preparation for the incoming image forming operation, all of the developing units are placed apart form the developing position. When the image forming operation starts, the developing unit for the first toner image is moved to the developing position.

In the color image forming apparatus of the multi-transfer type, the toner image is transferred from the photoreceptor drum to a print sheet on the image transfer drum every turn of the image transfer drum. The lengths of an image forming section and a nonimage forming section are determined by only the outside diameter of the image transfer drum and the size of the print sheet used. In connection with this, a specific example is given. When a print sheet of A3 size (of JIS (Japanese Industrial Standards) is used (moved longitudinally for image formation), the required circumferential length of the image transfer drum is at least 420 mm. To form an image by moving laterally a print sheet of A4 size (of JIS) by using the same image transfer drum, the required length of the image forming section is 210 mm, and then the length of the nonimage forming section is 210 mm or more. The result is that the nonimage forming section is longer than the image forming section.

This causes the following problems. In the color image forming apparatus constructed as mentioned above, after the image forming operation starts, any of the developing units is always located at the developing position. The time that the nonimage forming section on the photoreceptor drum faces the developing unit is inevitably long. As a result, the photoreceptor drum is soiled with toner from the developing unit. The toner transferred to the photoreceptor drum is further transferred to the image transfer drum. When a print sheet is put on the image transfer drum, the print sheet is also soiled with the toner.

The color image forming apparatus has edit functions, such as a color conversion and an image insertion composition. As known, the image insertion composition is an image editing process for forming a composite image by inserting a specified image on an original document into an image on another original. When using the edit function, image data is processed during a period of time between the formation of a toner image of a first color and the formation of a toner image of a second color. The data processing time must be integer times as long as the time of one turn of the image transfer drum. Accordingly, the nonimage forming section is correspondingly lengthened. The time that the nonimage forming section faces the developing unit is also elongated correspondingly. As a result, the soiling problem is more remarkable.

A technique that handles print sheets of large heat capacity, such as sheets for an overhead projector (OHP) and thick sheets, in the color image forming apparatus is disclosed in Unexamined Japanese Patent Publication 4-337751. In the publication, to give a satisfactory amount of heat energy to the print sheet, the drum speed of the image transfer drum is reduced after the transferring operation of the toner image of the final color onto the print sheet is completed. The print sheet bearing the toner image thereon is moved through the fixing unit at the reduced speed. Accordingly, the drum speed of the image transfer drum is increased and decreased during a period of time between the formation of an toner image of the final color and the formation of an toner image of the next first color. The speed changing time must also be integer times as long as the time of one turn of the image transfer drum. Accordingly, also in this case, the nonimage forming section on the photoreceptor drum is correspondingly lengthened, and the time that the photoreceptor drum faces the developing unit is elongated. The soiling problem remains unsolved.

In a case where a monocolor image, not a color image, is successively formed on a plural number of print sheets, a specific developing unit is continuously set at the developing position for a period of time from the start and the end of the image forming operation. Accordingly, the time that the photoreceptor drum faces the developing unit is elongated. The soiling problem is still left unsolved.

Also in the case of forming a full color image, the developing units are successively moved to the developing position immediately after one developing operation is completed. Any of the developing units is placed at the developing position, excepting the changing of the developing unit. As a result, the developing unit faces the image transfer drum for a long time. The apparatus suffers from the same problem.

SUMMARY OF THE INVENTION

The present invention has been made in view of the above circumstances and has an object to provide a color image forming apparatus which reduces the time that the photoreceptor drum faces the developing unit is reduced, whereby the image carrier means and the image transfer member are prevented from soiling by toner, and hence the formation of a quality color picture is realized.

To achieve the above object, a color image forming apparatus of the present invention comprises an image carrier member on which latent electrostatic images for respective colors are successively formed in accordance with image data, a plural number of developing means containing different colors respectively assigned thereto, developing-means replacing means for moving the developing means at a position facing the image carrier member in order to develop a latent electrostatic image into a visual image, and an image transfer member for transferring the toner images of the respective colors on a print sheet in a superposed fashion, the image transfer member being turned in synchronism with the image carrier member while holding a print sheet thereon, the toner images being formed on the image transfer member every turn of the image transfer member, improved in that when one or more number of turns of the image transfer member are present after the image transfer member is rotated one turn for transferring a toner image of a first color onto the print sheet but before the image transfer member is rotated one turn for transferring a toner image of a second color thereonto, the developing-means replacing means moves all of the developing means apart from the position facing the image carrier member during the period of time of one or more turns.

In a color image forming apparatus of the present invention, when one or more number of turns of the image transfer member are present after the image transfer member is rotated one turn for transferring a toner image of the final color onto a print sheet but before the image transfer member is rotated one turn for transferring a toner image of a first color on another print sheet, the developing-means replacing means moves all of the developing means apart from the position facing the image carrier member during the period of time of one or more turns.

In a color image forming apparatus, when a monochromatic toner image is successively transferred onto a plural number of print sheets, the developing-means replacing means moves all of the developing means apart from the position facing the image carrier member during the period of time of one or more turns every time the formation of the toner image during one turn of the image transfer member is completed.

In a color image forming apparatus, when a superposed color toner image is transferred onto a print sheet, the developing-means replacing means moves all of the developing means apart from the position facing the image carrier member during a period ranging from a time point after a toner image of a first color is formed on the image carrier member during a first turn of the image transfer member to a time point immediately before a toner image of a second color is formed during a second turn of the image transfer member.

The plural number of the developing means thus operated may be driven in various ways. In one possible way, the developing means are angularly arrayed in a rotary body, which is driven by a motor. By properly controlling a turn angle of the drive motor, the developing means are successively moved to the developing position one by one, and by moving the rotary body apart from the image carrier member, the developing means is also moved apart from the same.

According to the invention, in the color image forming apparatus, image data is processed during a period of time between one turn of the image transfer member to transfer a toner image of a first color and one turn of the image transfer member to transfer a toner image of a second color. During the image data processing time, if image transfer member is repeatedly turned with no toner image being formed on the image carrier member, the developing-means replacing means moves all of the developing means from the developing position. Therefore, the time that the developing means faces the nonimage forming section on the image carrier member at the developing position is not long.

Further, in the color image forming apparatus, the speed of the image transfer member is varied during a period of time between one turn of the image transfer member to transfer a toner image of the final color onto a print sheet and one turn of the image transfer member to transfer a toner image of a first color onto another print sheet. During the speed varying time, if the image transfer member is repeatedly turned with no toner image being formed on the image carrier member, the developing-means replacing means moves all of the developing means from the developing position during this period of time. Therefore, the time that the developing means faces the nonimage forming section on the image carrier member at the developing position is not long.

Further, in the color image forming apparatus, even when a monochromatic toner image is successively transferred onto a plural number of print sheets, and hence the nonimage forming section is lengthened during one turn of the image transfer member, the developing-means replacing means moves all of the developing means from the developing position every time the toner image formation is completed. Therefore, the time that the developing means faces the nonimage forming section on the image carrier member at the developing position is not long.

Further, in the color image forming apparatus, all of the developing means are moved apart from the developing position also when a multi-color toner image is transferred onto a print sheet. Therefore, there is eliminated such a situation that the developing means stays at the developing position for a long time.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention. In the drawings.

DETAILED DESCRIPTION OF THE PREFERRED EMBODIMENTS

The preferred embodiments of a color image forming apparatus according to the present invention will be described with reference to the accompanying drawings.

Figure 1:
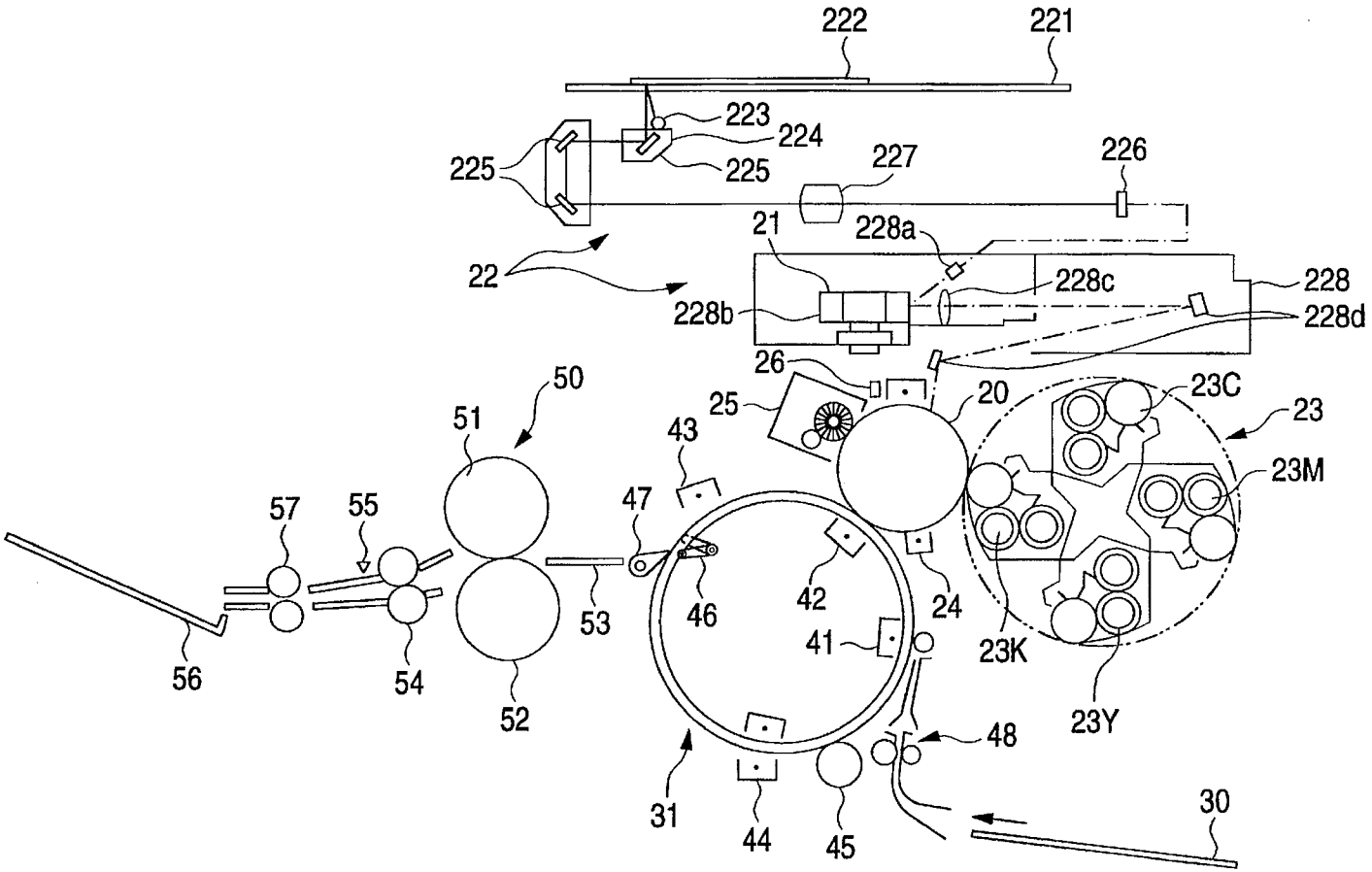
FIG. 1 is a side view schematically showing an embodiment of a color image forming apparatus of the present invention.
Figure 2:
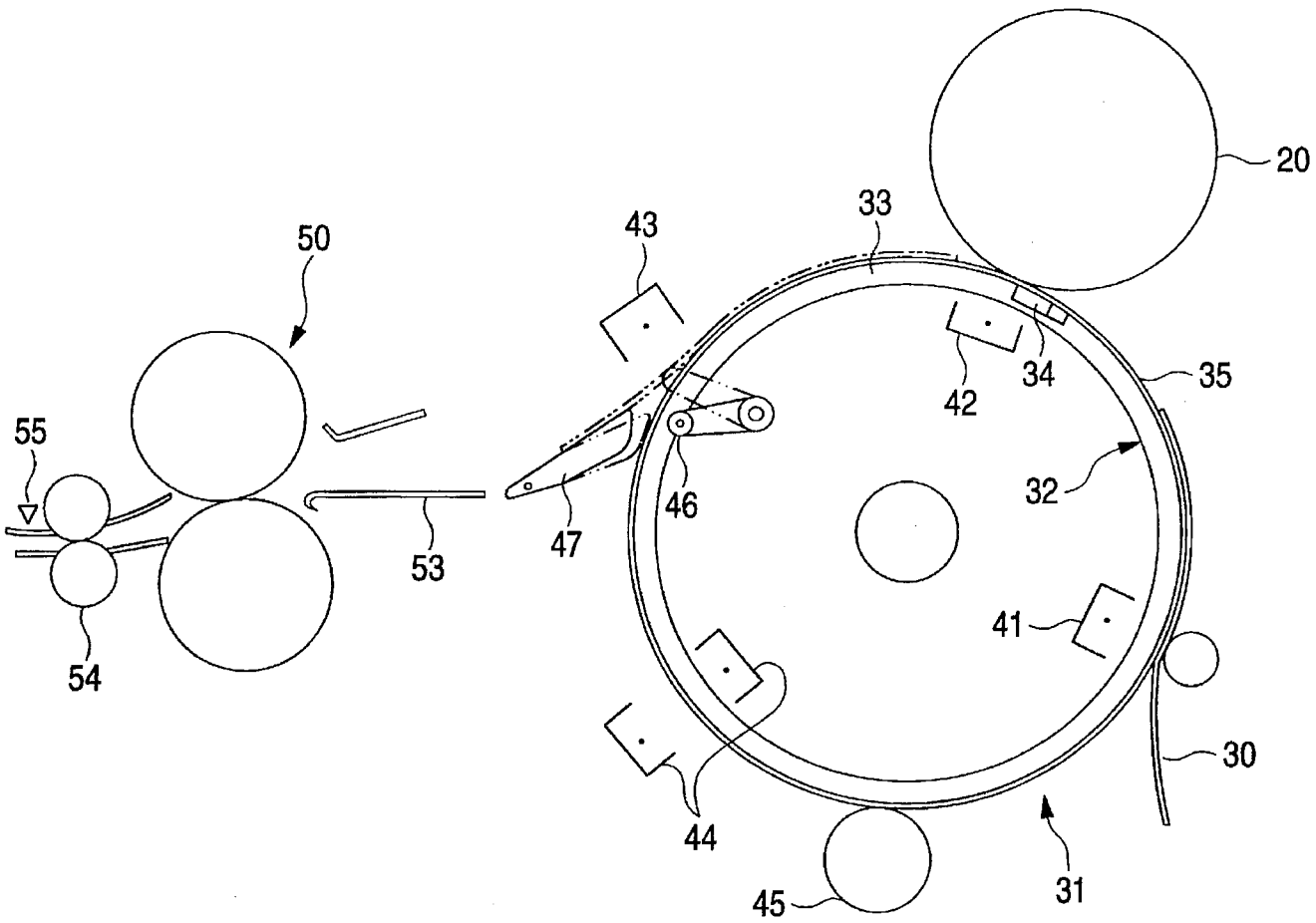
FIG. 2 is a side view schematically showing an image transfer drum and its related components in the color image forming apparatus.

FIGS. 1 and 2 show a color copying machine incorporating the present invention, which is a first embodiment of the present invention. In those figures, reference numeral 20 designates a photoreceptor in the form of a drum; 21, a charging corotron for charging the surface of the photoreceptor 20 in advance; 22, an exposure/scan system for writing a latent electrostatic image on the surface of the photoreceptor 20 that is charged by the charging corotron 21; 23, a rotary developing unit in which four developing subunits 23B, 23C, 23M and 23Y for forming toner images of black (B), cyan (C), magenta (M) and yellow (Y) are rotatably selectively arranged; 24, a pre-transfer corotron for removing potential on the surface of the photoreceptor 20; 25, a cleaner for removing residual toner from the surface of the photoreceptor 20; and 26, an eraser lamp for erasing residual charge on the surface of the photoreceptor 20.

In the present embodiment, the exposure/scan system 22 is made up of an exposure lamp 223 for projecting a light beam on an original document 222 placed on a platen 221, a carriage 224 for moving the exposure lamp 223 over the original document 222, a reflection mirror 225 for guiding along a preset path a light beam that is emitted from the exposure lamp 223 and reflected from the surface of the original document 222, a color image sensor 226 for converting a light beam from the original document 222 into digital signals of the respective color components, an image forming lens 227 for focusing light beams from the original document 222 surface on the color image sensor 226, and a laser scan unit 228 for scanning the surface of the photoreceptor drum 20 in the fast scan direction with a laser beam in accordance with the image signals of the respective color components that are gathered by the color image sensor 226. The laser scan unit 228 is made up of a semiconductor laser 228*a*, a polygonal mirror 228*b* for swinging a laser beam form the semiconductor laser 228*a* over the surface of the photoreceptor drum 20 in the fast scan direction, an image forming lens 228*c* for focusing laser beams from the semiconductor laser 228*a* along the main scan lines on the surface of the photoreceptor drum 20, and a reflection mirror 228*d* for controlling the beam path.

Figure 3:
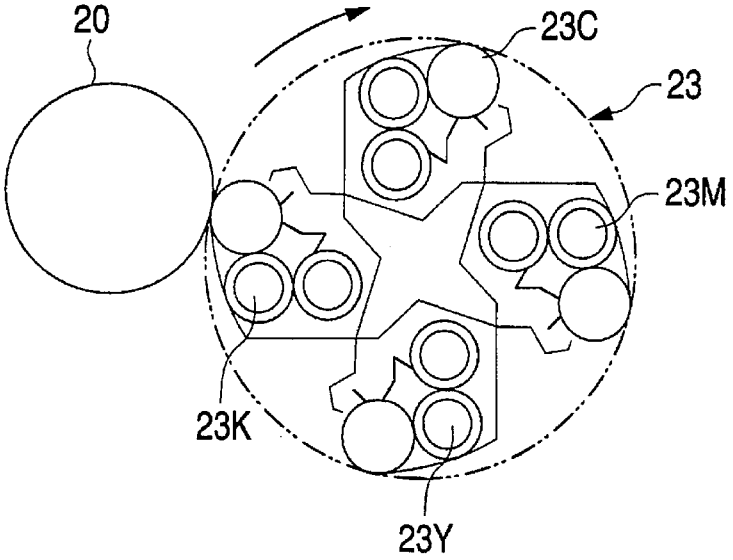
FIG. 3 is a side view showing a rotary developing unit used in the color image forming apparatus, the illustration showing a developing position of the rotary developing unit.
Figure 4:
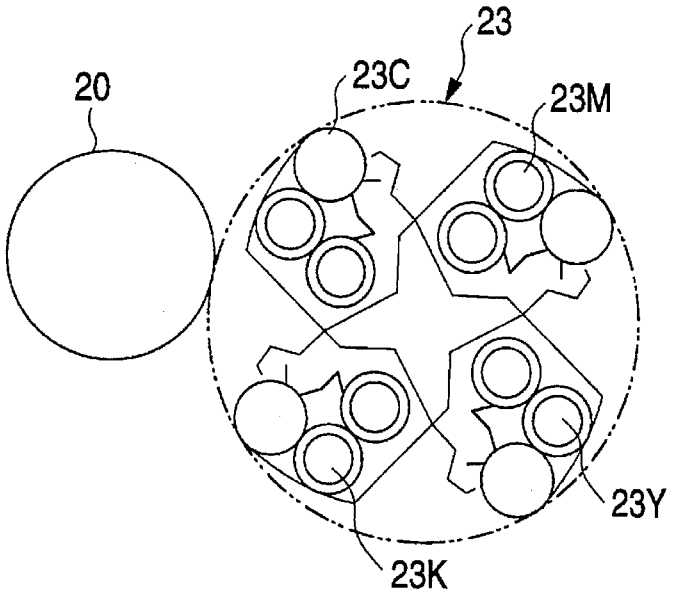
FIG. 4 is a side view showing a rotary developing unit used in the color image forming apparatus, the illustration showing a home position of the rotary developing unit.
Figure 5:
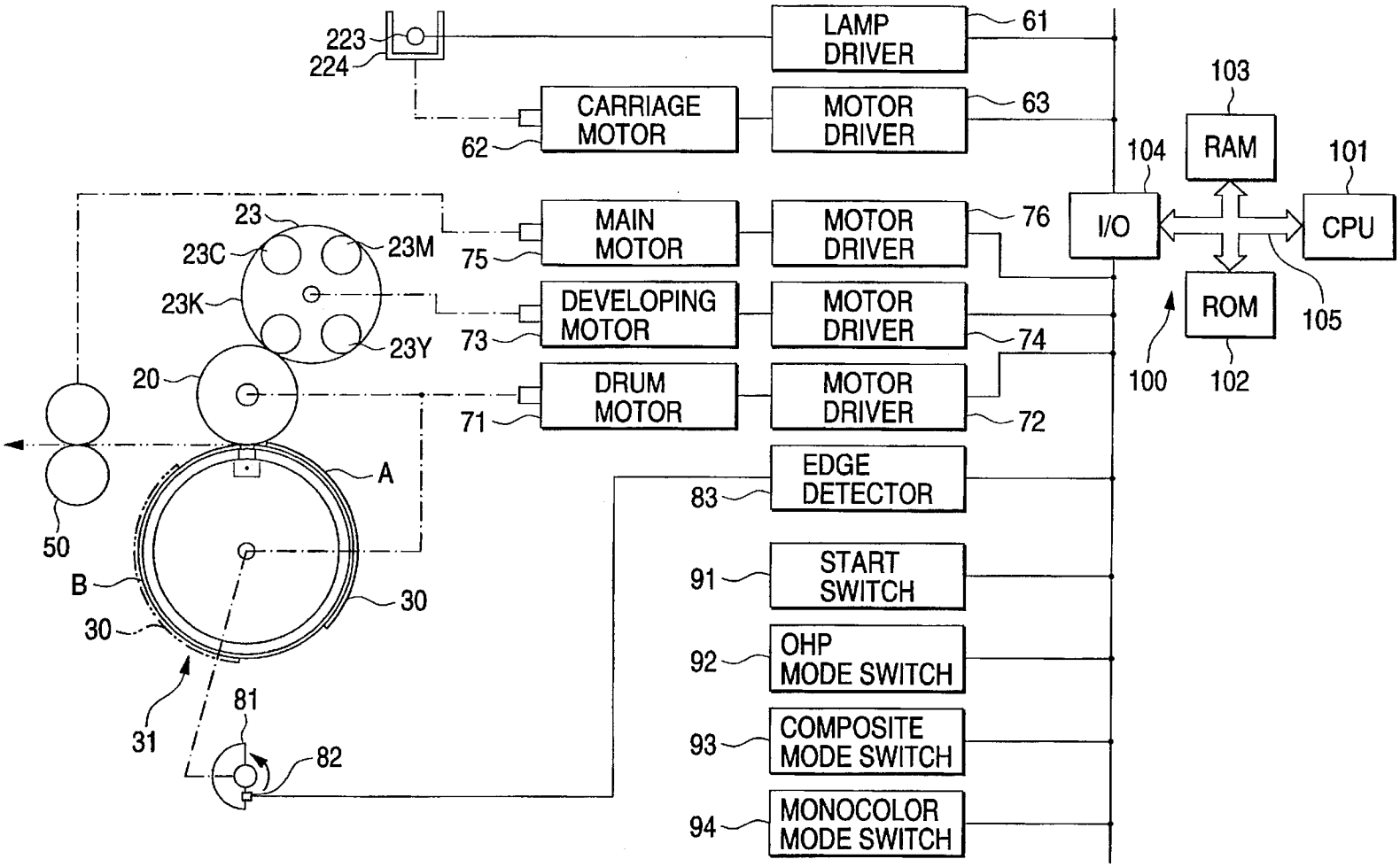
FIG. 5 is a diagram showing, in block and schematic form, a drive control system incorporated into the color image forming apparatus of the present invention.

The rotary developing unit 23 is driven for turn by a developing motor 73 (FIG. 5). When a copying operation starts, one (e.g., the black developing subunit 23K in FIG. 3) of the developing subunits 23B, 23C, 23M and 23Y is turned to be set at the developing position on the photoreceptor drum 20. The rotary developing unit 23 is turned in the steps of 90° in the direction of an arrow, to successively set the developing subunits 23B, 23C, 23M and 23Y at the developing position one by one. A position angularly spaced 45° from the cyan developing subunit 23C is used as the home position of the rotary developing unit 23. At the home position, all of the developing subunits 23B, 23C, 23M and 23Y are placed apart from the developing position. When the copying operation is completed, the rotary developing unit 23 is returned to the home position.

Figure 10:
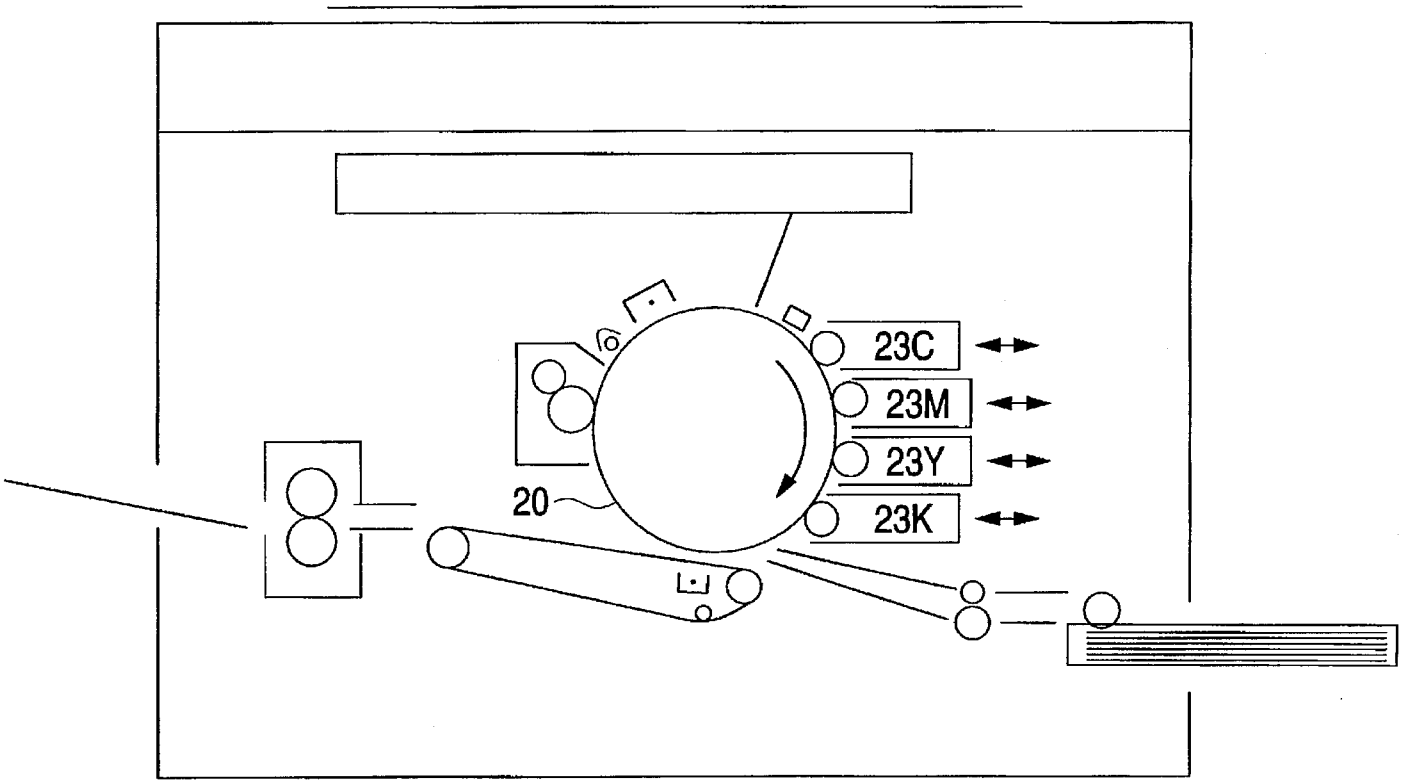
FIG. 10 is a side view schematically showing another color image forming apparatus according to the present invention.

Moreover, the present invention is applicable to a copying machine as shown in FIG. 10. In the copying machine, the developing units 23B, 23C, 23M and 23Y are parallelly arranged along the photoreceptor drum 20. Each of the developing units has a developing position and a home position. The rotary developing units are controlled such that one developing unit is selected from those developing units and moved to the developing position on the photoreceptor drum 20, and at this time the remaining ones remain apart from the drum surface.

Reference numeral 31 designates an image transfer drum. A print sheet 30 is wound around the image transfer drum 31. Toner images of the respective colors are successively transferred onto the print sheet 30 on the photoreceptor drum 20 being turned. As shown in FIG. 2, the image transfer drum 31 is constructed such that the outer surface of a drum frame 32 coupled together by a tie bar 34 is covered with a drum sheet 35, made of polyvinyliden fluoride, for example. The drum sheet 35, when charged in advance, electrostatically attracts the print sheet 30 thereto.

Disposed along the image transfer drum 31 are an attraction corotron 41, a transfer corotron 42, an erase corotron 43, a cleaning/erase corotron 44, a cleaning brush 45, a push roll 46, and a peel finger 47. The attraction corotton 41 charges the drum sheet 35 when it attracts the print sheet 30 thereto. The transfer corotron 42 transfers a toner image on the photoreceptor drum 20. The erase corotron 43 removes charges from the print sheet 30 after the transfer of the final color image is completed. The cleaning/erase corotton 44 removes charges from the drum sheet 35 when the transfer of the final color image is completed. The cleaning brush 45 removes paper particles, for example, from the drum sheet 35 when the transfer of the final color image is completed. The push roll 46, located inside the image transfer drum 31, pushes up the drum sheet 35 when the print sheet 30 is peeled off from the drum sheet 35. The peel finger 47 is used for peeling off the print sheet 30 from the drum sheet 35. Reference numeral 48 designates a sheet transport system transports the print sheet 30 to the location of the attraction corotron 41 in each operation mode. The print sheet 30 is fed from a sheet supply cassette, not shown.

A fusing/fixing unit 50 receives a print sheet 30 bearing color toner images transferred thereonto, and fuzes and fixes them onto the print sheet 30. In the present embodiment, the fusing/fixing unit 50 is made up of a heating roll 51 containing a heater therein, and a pressurizing roll 52 pressed against the heating roll 51. A print sheet 30 is transported from the image transfer drum 31 to the fusing/fixing unit 50 by way of a guide plate 53. A fuser output roll 54 transports forward the print sheet 30 leaving the fusing/fixing unit 50. A fuser output switch 55 detects the trailing edge of the print sheet 30 leaving the fusing/fixing unit 50. An exit tray 56 receives the print sheets 30 bearing fixed toner images, which are discharged from the machine. An exit roll 57 outputs the print sheet 30 to the exit tray 56.

A driver control system for the color copying machine thus constructed is shown in FIG. 5.

In the figure, reference numeral 61 designates a lamp driver for lighting on the exposure lamp 223, and numerals 62 and 63 designate a carriage motor for moving the carriage 224, and a motor driver for the carriage motor 62.

Numerals 71 and 72 represent a drum motor 71 for turning the photoreceptor drum 20 and the image transfer drum 31 synchronously, and a motor driver for the drum motor 71. Reference numerals 73 and 74 are representative of a developing motor for selectively driving the developing subunits 23B, 23C, 23M and 23Y of the rotary developing unit 23, and a motor driver 74 for the developing motor 73. Numerals 75 and 76 indicate a main motor for driving the fusing/fixing unit 50 and the sheet transport system, and a motor driver 76 for the main motor 75.

A semicircular plate 81 is provided coaxial with the image transfer drum 31. A photo sensor 82, consisting of a light emitting part and a photo sensing part, is located on at a location on the chord of the semicircular plate 81. The output of the photo sensor 82 is turned on and off every half turn of the image transfer drum 31. The leading and trailing edges of an output signal of the photo sensor 82 are detected by an edge detector circuit 83.

A microcomputer 100 contains a CPU 101, a ROM 102, a RAM 103, and an I/O port 104. These components are interconnected by a system bus 105. Various programs, such as copy execution programs (of a normal mode, an OHP mode, an insertion composition mode, and a monocolor mode), and a machine stop program are stored in advance in the R0M 102. During the execution of a program by the CPU 101, data is temporarily stored in the RAM 103. A pulse signal produced by the edge detector circuit 83 is applied as a reference timing signal into the microcomputer 100, through the I/O port 104. The microcomputer 100 outputs a motor control signal and a lamp turn-on signal to the motor drivers 63, 72, 74, and 76, through the I/O port 104. The carriage motor 62, the drum motor 71, and the main motor 75 are controlled by those signals.

Figure 11:
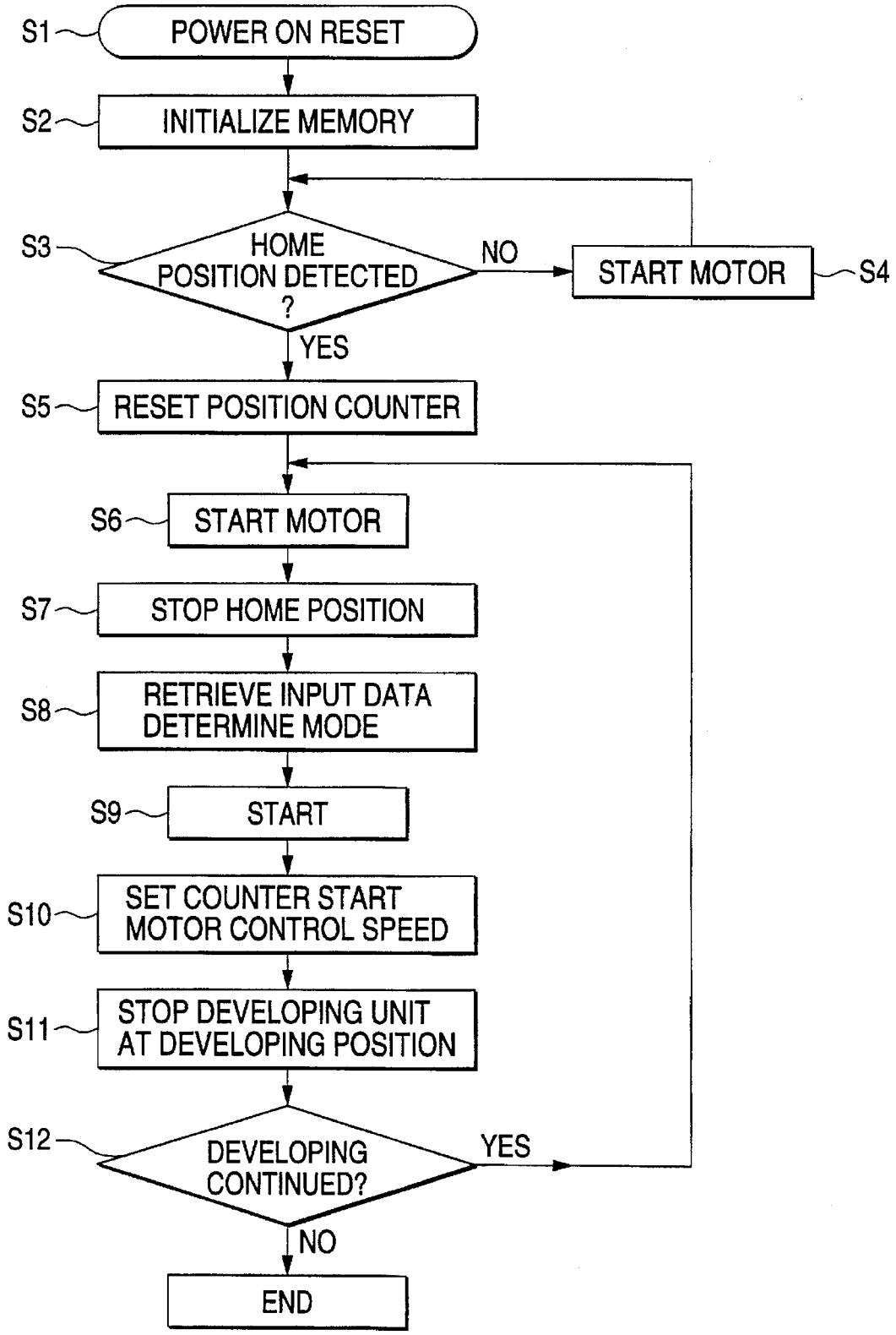
FIG. 11 is a flowchart showing the operation of the color image forming apparatus of the present invention.

The above-mentioned embodiment is explained with reference to FIG. 11. When a power switch is turned on (step S1), a reset signal is applied to the CPU 101 in the driver control system. In response to the reset signal, the RAM 103 and the I/O port 104 are initialized (step S2). The CPU 101 checks whether or not a signal produced by the photo sensor 82, which is for detecting the home position of the rotary developing unit 23, is present. (step S3)

When the CPU 101 receives no signal from the photo sensor 82, it transfers data indicative of starting the motor to the related components (step S4). When the home position is detected, a position counter of the rotary developing unit 23 is reset (step S5). Signals of the I/O port 104 of the microcomputer 100 are processed (step S6 and S7). After the input process is completed, the CPU 101 checks whether or not a copy start signal is present and checks the select mode currently set up (steps S8 and S9). The motors are started up and the speed of the motor is controlled in accordance with the signals produced by the CPU 101 (step S10).

The rotary developing unit 23 is turned, so that one of the developing subunits thereof is moved to the developing position in accordance with a count of the position counter. The developing subunit that has reached the developing position is detected and stopped thereat (step S11). The developing operation is performed, and the CPU 101 checks whether or not a further developing operation is required (step S12). The sequence of the developing steps is repeated.

The operation of the color copying machine thus constructed will be described.

Normal mode (print on a normal paper)

To start with, an operator selects a 4-color mode and turns on a start switch 91. Then, the drum motor 71 and the main motor 75 are synchronously driven to cycle up the system. Upon completion of the cycle up, the exposure lamp 223 is lit on by the first turn of the image transfer drum 31, while at the same time the carriage motor 62 is driven, to thereby scan an original document 222. As a result, a latent electrostatic image for black K is written into the surface of the photoreceptor drum 20.

Figure 6:
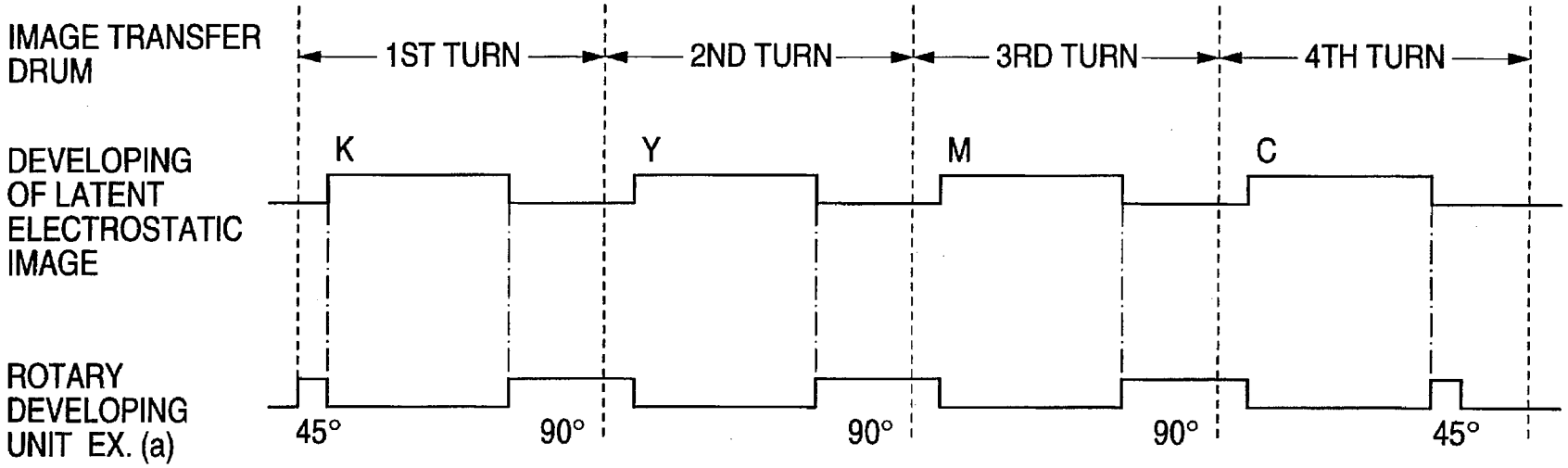
FIGS. 6(*a*) and (*b*) are timing diagrams showing the image forming operation of the color image forming apparatus in a normal mode.
Figure 6:
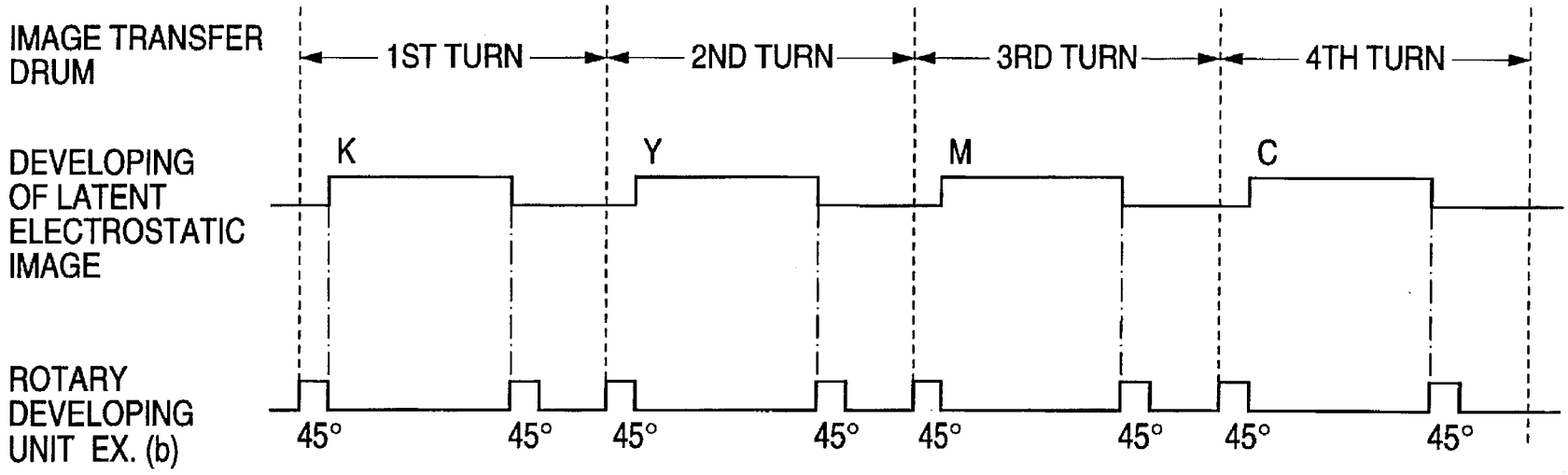

As shown in FIGS. 6(*a*) and (*b*), the developing motor 73 is driven to turn at a preset timing corresponding to the first turn of the image transfer drum 31. The rotary developing unit 23 that is set at the home position is turned 45°, so that the developing subunit 23K is set at the developing position. The latent electrostatic image is developed, by the developing subunit 23K, a little later than written. The toner image of black K thus developed is transferred onto the print sheet 30 held on the image transfer drum 31. After the developing process by the developing subunit 23K is completed, the developing motor 73 is driven to turn the rotary developing unit 23 by 90° before the yellow developing subunit 23Y starts its developing operation (FIG. 6(*a*)). Alternatively, the rotary developing unit 23 turns in two steps of 45° (FIG. 6(*b*)). During the turning operation, the developing subunit may be set at the home position. The yellow developing subunit 23Y is consequently set at the developing position. Then, the system operation enters the developing phase.

The original document 222 is scanned at a preset timing corresponding to the second turn of the image transfer drum31. A latent electrostatic image for yellow Y is written into the surface of the photoreceptor drum 20. The latent electrostatic image is developed, by the yellow developing subunit 23Y, a little later than written. After the developing process by the yellow developing subunit 23Y is completed, the rotary developing unit 23 is turned as in the pervious manner, and the magenta developing subunit 23M is set at the developing position. The toner image of yellow Y thus developed is transferred onto the print sheet 30 held on the image transfer drum 31.

The sequence of the developing process steps as referred to above is repeated for the third turn and the fourth turn of the image transfer drum 31. Toner images of magenta M and cyan C are transferred from the photoreceptor drum 20 onto the print sheet 30 of the image transfer drum 31. As a result, the toner images of four colors are formed on the print sheet 30 in a superposed fashion. After the transfer of the toner image of cyan C onto the print sheet 30, the print sheet 30 is peeled off from the image transfer drum 31, and transported to the fusing/fixing unit 50 and then discharged into the exit tray 56. After the developing process for cyan C is completed, the rotary developing unit 23 is turned 45° to be set at the home position. If the operation for a preset number of copies is set before the copy start, the rotary developing unit 23 is turned as in the above case, and the developing subunit 23K is set at the developing position.

Insertion Composition Mode

The insertion composition mode is used when an image of a specified area on an original document is inserted into a designated area on another original document, and then the thus composed image is copied. To this end, the color copying machine reads the images on two original documents by the exposure/scan system 22, and a process of composing these images is carried out. During the composing operation, the photoreceptor drum 20 and the image transfer drum 31 are being turned by the drum motor 71.

The user selects the 4-color mode, turns on a composite mode switch 93 to select an insertion composition mode, and then turns on the start switch 91. After the cycle up of the system is completed, the exposure/scan system 22 is scanned at a preset timing corresponding to the first turn of the image transfer drum 31. As a result, a latent electrostatic image for black K is written into the surface of the photoreceptor drum 20.

Figure 7:
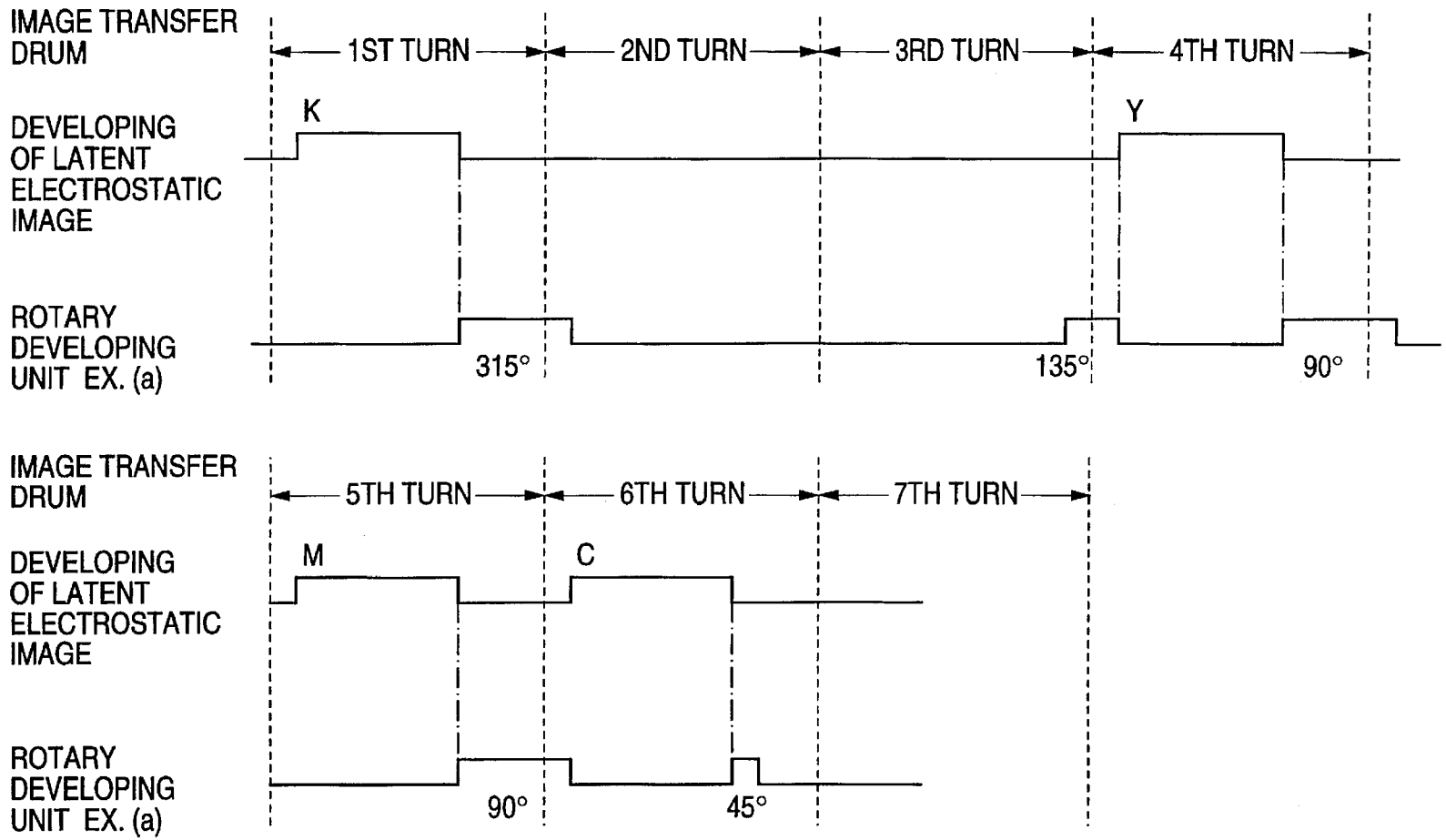
FIGS. 7(*a*) and (*b*) are timing diagrams showing the image forming operation of the color image forming apparatus in an insertion composition mode.
Figure 7:
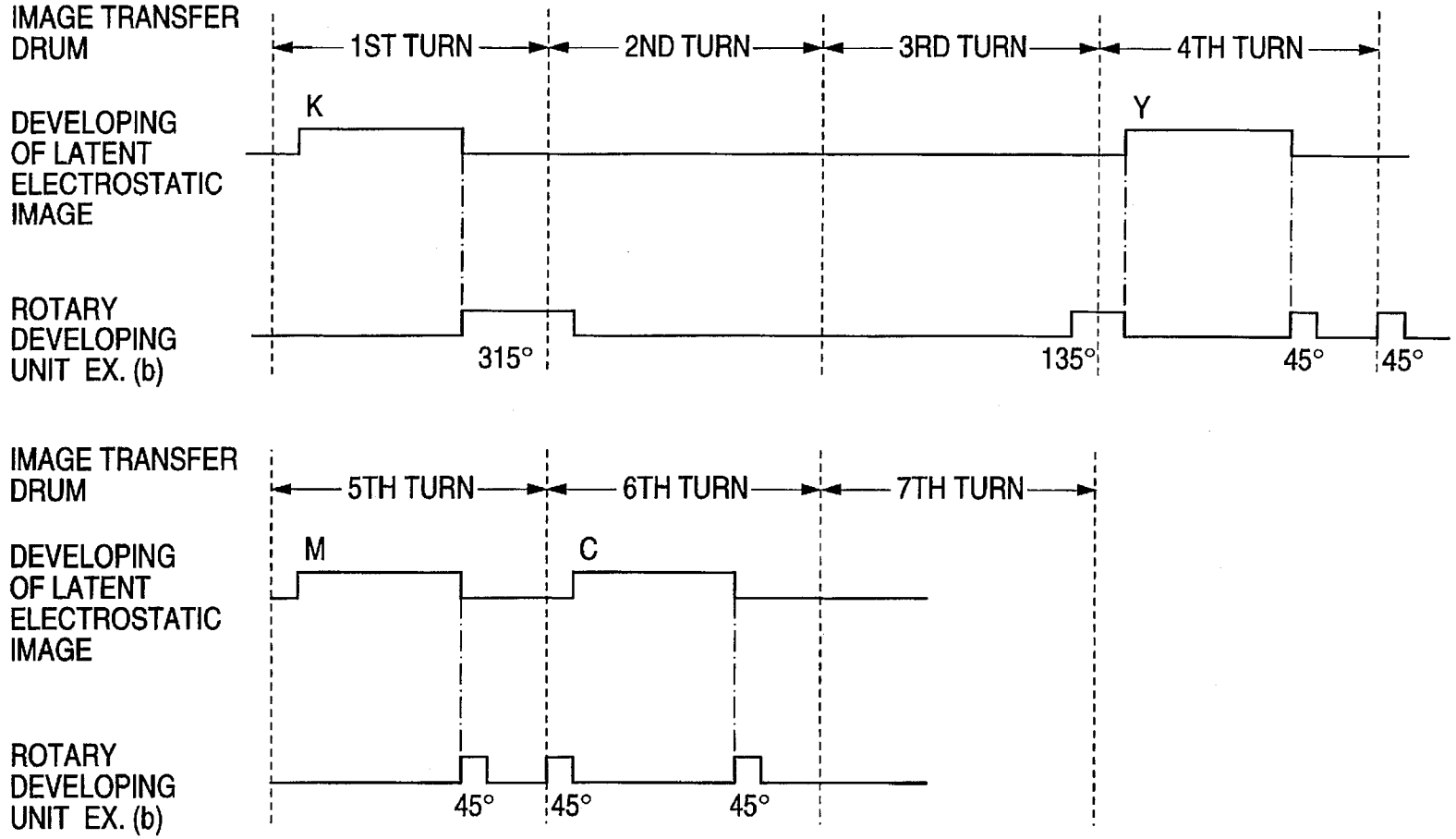

The rotary developing unit 23 being set at the home position is turned 45° at a preset timing corresponding to the first turn of the image transfer drum 31, and the developing subunit 23K is moved to the developing position as shown in FIGS. 7(*a*) and (*b*). The latent electrostatic image is developed, by the developing subunit 23K, a little later than written. The toner image of black K thus developed is transferred onto the print sheet 30 held on the image transfer drum 31. After the developing process by the developing subunit 23K is completed, the developing motor 73 is driven to turn the rotary developing unit 23 by 315°, and the developing unit 23 is set at the home position.

In this mode, the second and third turns of the image transfer drum 31 (if required, a further number of turns) are assigned to the time for processing image data. Accordingly, no toner image is formed on the photoreceptor drum 20, and the image transfer drum 31 is idly turned while holding the print sheet 30 having the toner image of black K thereon. During the image processing, the rotary developing unit 23 is set at the home position, and all of the rotary developing subunits are apart from the developing position. Therefore, toner will never be transferred from the rotary developing unit to a nonimage forming section on the photoreceptor drum 20. Accordingly, the print sheet 30 held on the image transfer drum 31 is not soiled with toner.

Upon the completion of the processing of image data, the original document 222 is scanned at a preset timing corresponding to the fourth turn of the image transfer drum 31. A latent electrostatic image for yellow Y is written into the surface of the photoreceptor drum 20. The rotary developing unit 23 is turned 135° from the home position, so that the yellow developing subunit 23Y is set at the developing position. The latent electrostatic image is developed by the yellow developing subunit 23Y a little later than written. Following the developing process, the rotary developing unit 23 is similarly turned 90° (FIG. 7(*a*)) or in the two steps of 45° (FIG. 7(*b*)), so that the magenta developing subunit 23M is set at the developing position. The toner image of yellow Y is transferred onto the print sheet 30 put on the image transfer drum 31.

As for the color components of magenta M and of cyan C, the processing of the image data thereof is already completed. The toner image of magenta M is formed at the fifth turn of the image transfer drum 31, and the toner image of cyan C is formed at the sixth turn thereof. These toner images are transferred onto the print sheet 30. As a result, the toner images of four colors are formed on the print sheet 30 in a superposed fashion. Following the developing process for magenta M, the rotary developing unit 23 is similarly turned 90° (FIG. 7(*a*)) or in the two steps of 45° (FIG. 7(*b*)), so that the cyan developing subunit 23C is set at the developing position. After the developing process for cyan C is completed, the rotary developing unit 23 is turned 45°, and set at the home position.

In the insertion composition mode, the following operation is allowed. The rotary developing unit 23 is turned 45° after the developing process for black K is completed, and further turned 45° before the developing process for yellow Y starts, to set the yellow developing subunit 23Y at the developing position.

OHP mode

In the OHP mode, an OHP sheet is used for the print sheet 30, and an image on an original document 222 is copied on the OHP sheet. The OHP sheet has a larger heat capacity than the normal sheet. To cope with this, in the present embodiment, a fixing speed V2 (e.g., 60 mm/sec) of the OHP sheet 30 when it passes through the fusing/fixing unit 50 is set to be lower than a fixing speed V1 (e.g., 160 mm/sec) of the normal sheet. For this reason, when an image is successively copied on a plural number of OHP sheets 30, the speed of the image transfer drum 31 is decreased from the speed V1 to V2 before the OHP sheet 30 is peeled off from the image transfer drum 31, and the speed of the image transfer drum 31 is increased from the speed V2 to V1 before the exposure/scan operation is performed for the second OHP sheet 30. During the periods of time of changing the drum speed of the image transfer drum 31, it is impossible to form a toner image on the photoreceptor drum 20.

The user selects the 4-color mode, turns on an OHP mode switch 92, to select an OHP mode, and then turns on the start switch 91. After the cycle up of the system is completed, the exposure/scan system 22 is scanned at a preset timing corresponding to the first turn of the image transfer drum 31. As a result, a latent electrostatic image for black K is written into the surface of the photoreceptor drum 20.

Figure 8:
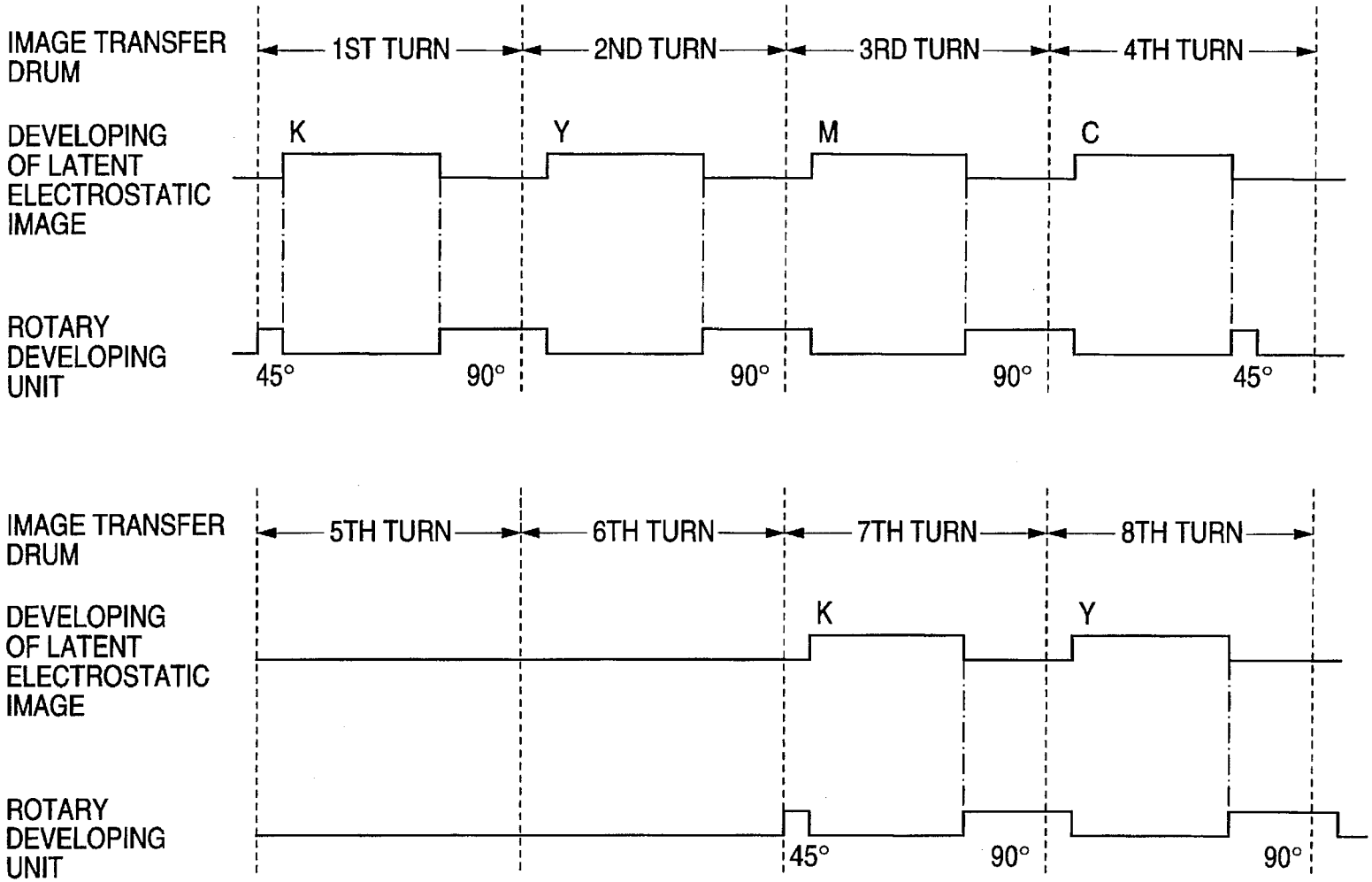
FIG. 8 is a timing diagram showing the image forming operation of the color image forming apparatus in an OHP mode.

The rotary developing unit 23 being set at the home position is turned 45° at a preset timing corresponding to the first turn of the image transfer drum 31, and the black developing subunit 23K is moved to the developing position (FIG. 8). The latent electrostatic image is developed, by the developing subunit 23K, a little later than written. The toner image of black K thus developed is transferred onto the OHP sheet 30 held on the image transfer drum 31. After the developing process by the developing subunit 23K is completed, the developing motor 73 is driven to turn the rotary developing unit 23 by 45°, and the yellow developing subunit 23Y is set at the developing position. Subsequently, as in the normal mode, the toner images of yellow Y, magenta M and cyan C are successively formed on the photoreceptor drum 20. The toner images of four colors are formed on the OHP sheet 30 put on the image transfer drum 31, in a superposed fashion. After the developing process for cyan C is completed, the rotary developing unit 23 is turned 45° to primarily be set at the home position.

When the toner image of cyan C has been transferred onto the OHP sheet 30 held on the image transfer drum 31, the image transfer drum 31 makes a beginning of the fifth turn while holding the OHP sheet 30 thereon. During the fifth turn, the drum speed of the image transfer drum 31 is decreased from V1 to V2. And when the drum speed is decreased to V1 and the OHP sheet 30 is peeled off from the image transfer drum 31, the image transfer drum 31 enters on the sixth turn. During this turn, the drum speed is returned from V2 to V1. To secure a reliable transfer register of the toner image, the same drum motor 71 is used for driving the photoreceptor drum 20 and the image transfer drum 31. Accordingly, if the drum speed of the image transfer drum 31 is varied, the drum speed of he photoreceptor drum 20 is correspondingly varied. Accordingly, during the fifth turn and the sixth turn of the image transfer drum 31, it is impossible to form the toner image on the photoreceptor drum 20. During the period of the fifth and sixth turns, the rotary developing unit 23 is left set at the home position, all of the developing subunits are apart from the developing position. Then, no toner flies to the nonimage forming section on the photoreceptor drum 20 from the developing unit. Accordingly, the image transfer drum is not soiled with toner.

When the drum speed of the image transfer drum 31 is returned from V2 to V1, the original document 222 is scanned at a preset timing corresponding to the seventh turn of the image transfer drum 31, and a latent electrostatic image for the next OHP sheet is written onto the photoreceptor drum 20. The rotary developing unit 23 is turned 45° from the home position, so that the developing subunit 23K is set at the developing position. The latent electrostatic image is developed, by the developing subunit 23K, a little later than written. The toner image of black K thus developed is transferred onto the OHP sheet 30 held on the image transfer drum 31.

As in the case of the first OHP sheet, the color toner images are transferred onto the OHP sheet in a superposed fashion, and then fused and fixed. If nothing is copied on the next new OHP sheet, the rotary developing unit 23 is turned 45° and set at the home position after the developing process of the toner image of cyan C is completed.

Monocolor Mode

This mode is used for successively copying a monochromatic image on an original document on a plural number of print sheets.

The user designates black K, turns on a monocolor mode switch 94 to select an OHP mode, and then turns on the start switch 91. Then, the drum motor 71 and the main motor 75 are synchronously driven and the cycle up of the system is performed. Upon the completion of the cycle up, the exposure lamp 223 is lit on at a preset timing corresponding to the first turn of the image transfer drum 31, while at the same time, the carriage motor 62 is driven and the original document 222 is scanned. As a result, a latent electrostatic image for black K is written into the surface of the photoreceptor drum 20.

Figure 9:
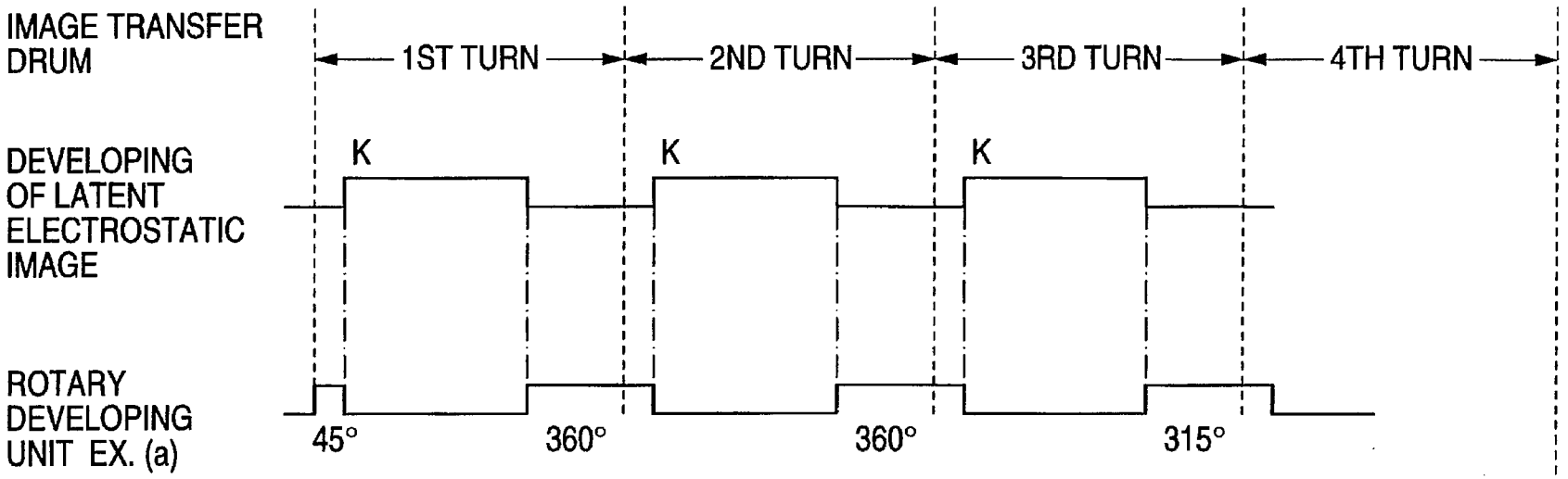
FIGS. 9(*a*), (*b*) and (*c*) are timing diagrams showing the image forming operation of the color image forming apparatus in a monocolor mode.
Figure 9:
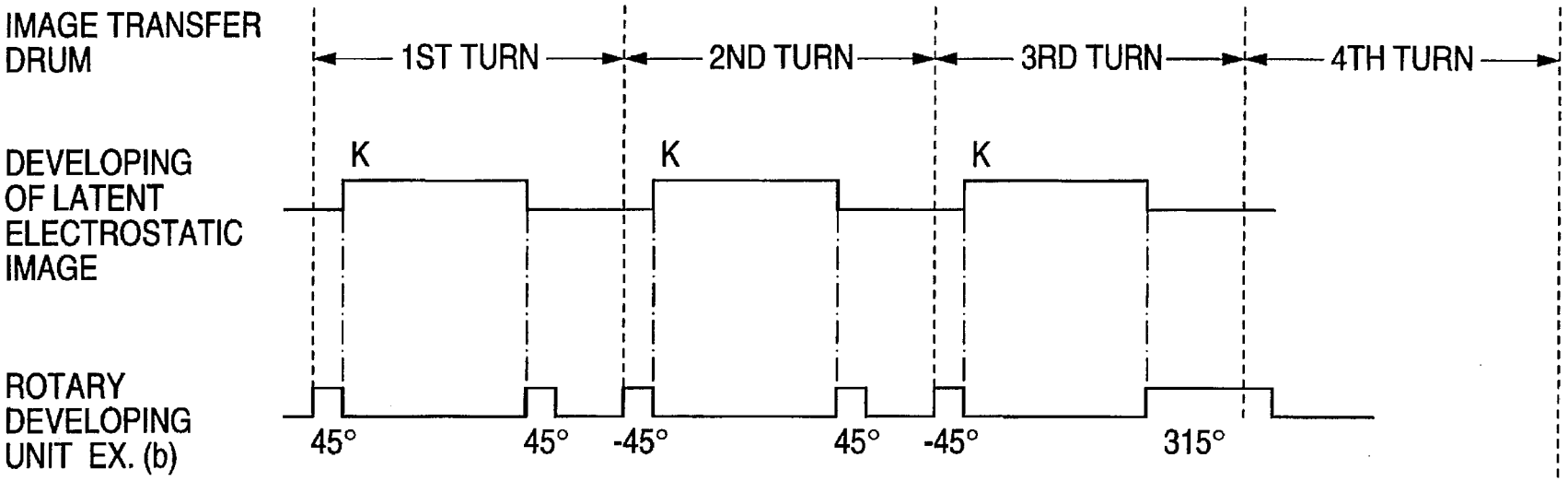
Figure 9:
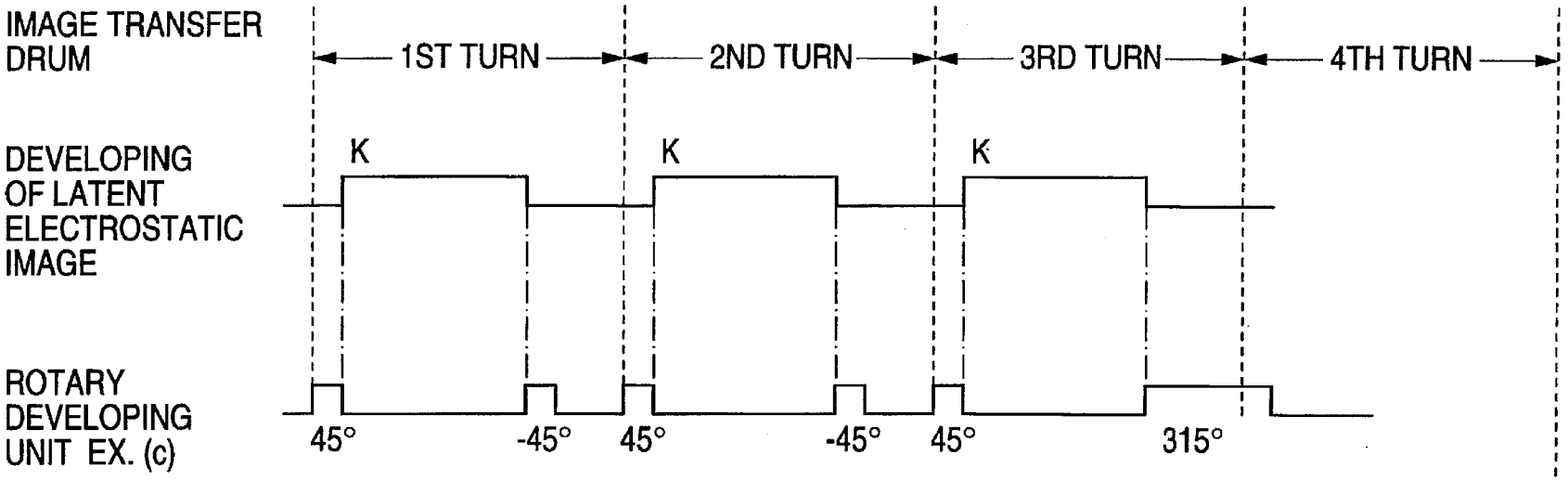

The rotary developing unit 23 being set at the home position is turned 45° at a preset timing corresponding to the first turn of the image transfer drum 31, and the developing subunit 23K is moved to the developing position (FIG. 9(*a*)). The latent electrostatic image is developed, by the developing subunit 23K, a little later than written. The toner image of black K thus developed is transferred onto the print sheet 30 held on the image transfer drum 31, the print sheet is peeled off the image transfer drum 31, and transported to the fusing/fixing unit 50.

Subsequently, the original document 222 is scanned at a preset timing every turn of the image transfer drum 31, a latent electrostatic image is written onto the photoreceptor drum 20, the latent electrostatic image is developed by the black developing subunit 23K, and the developed image is transferred onto the print sheet 30. The rotary developing unit 23 is turned 360° every time the developing process that is carried out for each turn of the image transfer drum 31 ends. And it is set again at the developing position before the next developing process starts.

Where a print sheet of A4 size (of JIS (Japanese Industrial Standard)) is longitudinally fed for copying, the image forming segment is 297 mm. The color copying machine of the present embodiment is designed so as to accept the longitudinal transport of the print sheet of A3 size (of JIS). Accordingly, the outside diameter of the image transfer drum 31 is 168 mm, and the cirmuferential length thereof is 168 $\pi$. Hence, the nonimage forming segment is 230.8 ($168\pi-297=230.8$). If the drum speed V1 of the image transfer drum 31 is 160 mm/sec, the time taken for the nonimage forming segment to pass the location facing the rotary developing unit 23 is 1.442 sec (=230.8/160). Therefore, the rotary developing unit 23 is necessary to turn 360° within this time duration. It is experimentally acknowledged that it is realized this by using the stepping motor of 0.9Ω, operated under the condition that the input voltage is 40 V and the inertial load is 6 $kg\cdot cm^2$.

In the monocolor mode, the rotary developing unit 23 is turned 360° every time the developing process that is carried out for each turn of the image transfer drum 31 ends. All of the developing subunits are apart from the developing position. Therefore, the developing subunit faces the nonimage forming segment on the photoreceptor drum 20 for a reduced time. As a result, the possibility that toner flies from the developing subunit to the nonimage forming section is correspondingly reduced.

Another sequence of turning the rotary developing unit 23 for image forming in the monocolor mode is shown in FIG. 9(*b*). As shown, the rotary developing unit 23 is turned 45° every time the developing process that is carried out for each turn of the image transfer drum 31 ends. Then, because of the restriction by time and reduction of addition, it is reversely turned 45° before the next developing process starts, to thereby set the black developing subunit 23K again at the developing position. Additionally, the sequence of turning the rotary developing unit 23 may be substituted by that shown in FIG. 9(*c*).

As seen from the foregoing description, in the color image forming apparatus of the present invention, it is for a reduced time that the developing unit set at the developing position faces the nonimage forming segment on an image carrier means. Therefore, the image carrier means and the image transfer means are little soiled with toner. A quality image formation is secured.

What is claimed is:

1. A color image forming apparatus comprising:

an image carrier member on which latent electrostatic images for respective colors are successively formed in accordance with image data;

an image transfer member for transferring the toner images of the respective colors on a print sheet in a superposed fashion, the image transfer member being turned in synchronism with the image carrier member while holding a print sheet thereon, the toner images being formed on the image transfer member every turn of the image transfer member;

a plural number of developing means containing different colors respectively assigned thereto; and developing-means replacing means operating such that the developing-means replacing means sets one of the plural number of developing means to be used for developing a latent electrostatic image at a position facing the image carrier member, and when one or more number of turns of the image transfer member are needed after the image transfer member is rotated one turn for transferring a toner image of a first color onto the print sheet but before the image transfer member is rotated one turn for transferring a toner image of a second color thereonto, the developing-means replacing means moves all of the developing means apart from the position facing the image carrier member during the period of time of one or more turns.

2. The color image forming apparatus according to claim 1, in which the plural number of developing means are assembled into a rotary body, and when the rotary body is turned, the plural number of developing means are moved to the position facing the image carrier member one by one.

3. A color image forming apparatus comprising:

an image carrier member on which latent electrostatic images for respective colors are successively formed in accordance with image data;

an image transfer member for transferring the toner images of the respective colors on a print sheet in a superposed fashion, the image transfer member being turned in synchronism with the image carrier member while holding a print sheet thereon, the toner images being formed on the image transfer member every turn of the image transfer member;

a plural number of developing means containing different colors respectively assigned thereto; and developing-means replacing means operating such that the developing-means replacing means sets one of the plural number of developing means to be used for developing a latent electrostatic image at a position facing the image carrier member, and when one or more number of turns of the image transfer member are needed after the image transfer member is rotated one turn for transferring a toner image of the final color onto a print sheet but before the image transfer member is rotated one turn for transferring a toner image of a first color oh another print sheet, the developing-means replacing means moves all of the developing means apart from the position facing the image carrier member during the period of time of one or more turns.

4. The color image forming apparatus according to claim 3, in which the plural number of developing means are assembled into a rotary body, and when the rotary body is turned, the plural number of developing means are moved to the position facing the image carrier means one by one.

5. A color image forming apparatus comprising:

an image carrier member on which latent electrostatic images for respective colors are successively formed in accordance with image data;

an image transfer member for transferring the toner images of the respective colors on a print sheet in a superposed fashion, the image transfer member being turned in synchronism with the image carrier member while holding a print sheet thereon, the toner images being formed on the image transfer member every turn of the image transfer member;

a plural number of developing means containing different colors respectively assigned thereto; and developing-means replacing means operating such that the developing-means replacing means sets one of the plural number of developing means to be used for developing a latent electrostatic image at a position facing the image carrier member, and when a monochromatic toner image is successively transferred onto a plural number of print sheets, the developing-means replacing means moves all of the developing means apart from the position facing the image carrier member every time the formation of the toner image during one turn of the image transfer member is completed.

6. The color image forming apparatus according to claim 5, in which the plural number of developing means are assembled into a rotary body, and when the rotary body is turned, the plural number of developing means are moved to the position facing the image carrier member one by one, and every time the formation of the toner image during one turn of the image transfer member is completed, the developing-means replacing means moves one developing means to be used for developing apart from the position facing the image carrier member, and rotates the rotary body by one turn during a period up to a time point immediately before the next toner image is formed.

7. The color image forming apparatus according to claim 5, in which the plural number of developing means are assembled into a rotary body, and when the rotary body is turned, the plural number of developing means are moved to the position facing the image carrier member one by one, and every time the formation of the toner image during one turn of the image transfer member is completed, the developing-means replacing means moves one developing means to be used for developing apart from the position facing the image carrier member, and reversely rotates the rotary body immediately before the next toner image is formed, to thereby return the developing means to the position facing the image carrier member.

8. A color image forming apparatus comprising:

an image carrier member on which latent electrostatic images for respective colors are successively formed in accordance with image data;

an image transfer member for transferring the toner images of the respective colors on a print sheet in a superposed fashion, the image transfer member being turned in synchronism with the image carrier member while holding a print sheet thereon, the toner images being formed on the image transfer member every turn of the image transfer member;

a plural number of developing means containing different colors respectively assigned thereto; and developing-means replacing means operating such that the developing-means replacing means sets one of the plural number of developing means to be used for developing a latent electrostatic image at a position facing the image carrier member, and when a superposed color toner image is transferred onto a print sheet, the developing-means replacing means moves all of the developing means apart from the position facing the image carrier member during a period ranging from a time point after a toner image of a first color is formed on the image carrier member during a first turn of the image transfer member to a time point immediately before a toner image of a second color is formed during a second turn of the image transfer member.

9. The color image forming apparatus according to claim 8, in which the plural number of developing means are assembled into a rotary body, and when the rotary body is turned, the plural number of developing means are moved to the position facing the image carrier member one by one.

* * * * *